US005809953A

United States Patent [19]

Saito et al.

[11] Patent Number: 5,809,953

[45] Date of Patent: Sep. 22, 1998

[54] VARIABLE VALVE TIMING MECHANISM

[75] Inventors: Tetsushi Saito; Hiroyuki Tsuzuku; Naoki Tsuchida, all of Iwata, Japan

[73] Assignee: Yamaha Hatsudoki Kabushiki Kaisha, Iwat, Japan

[21] Appl. No.: 947,093

[22] Filed: Oct. 8, 1997

Related U.S. Application Data

[62] Division of Ser. No. 630,281, Apr. 11, 1996.

[30] Foreign Application Priority Data

Apr. 12, 1995 [JP] Japan ..... 7-86782
Jun. 22, 1995 [JP] Japan ..... 7-156037

[51] Int. Cl.[6] ..... F01L 13/00

[52] U.S. Cl. ..... 123/90.16; 123/90.17; 123/90.21; 123/90.39

[58] Field of Search ..... 123/90.15, 90.17, 123/90.16, 90.2, 9.21, 90.22, 90.27, 90.39, 90.44, 90.48

[56] References Cited

U.S. PATENT DOCUMENTS

| | | | |
|---|---|---|---|
| 3,878,822 | 4/1975 | Beal | 123/90.16 |
| 5,235,940 | 8/1993 | Nakatani | 123/90.27 |
| 5,273,006 | 12/1993 | Schappertons et al. | 123/90.16 |
| 5,287,830 | 2/1994 | Dopson et al. | 123/90.16 |
| 5,297,505 | 3/1994 | Doll et al. | 123/90.16 |
| 5,351,661 | 10/1994 | Doll et al. | 123/90.16 |
| 5,419,290 | 5/1995 | Hurr et al. | 123/90.16 |
| 5,445,116 | 8/1995 | Hara | 123/90.16 |
| 5,456,225 | 10/1995 | Oikawa et al. | 123/90.16 |
| 5,463,988 | 11/1995 | Paul | 123/90.16 |
| 5,495,832 | 3/1996 | Fujii et al. | 123/90.16 |
| 5,529,032 | 6/1996 | Oikawa et al. | 123/90.16 |
| 5,564,373 | 10/1996 | Hara | 123/90.16 |

FOREIGN PATENT DOCUMENTS

| | | |
|---|---|---|
| 3521539 | 12/1986 | Germany . |
| 19544242 | 6/1996 | Germany . |
| 2139283 | 11/1984 | United Kingdom . |

*Primary Examiner*—Weilun Lo
*Attorney, Agent, or Firm*—Knobbe, Martens, Olson & Bear LLP

[57] ABSTRACT

A number of embodiments of twin overhead cam shaft reciprocating machines having a plurality of poppet valves. A variable valve timing mechanism is interposed between the cam shafts and respective of the poppet valves for varying their lift and for changing the number of effective poppet valves per cylinder. The lift changing mechanism includes means for shifting at least one rocker arm follower and provides a relatively compact yet highly efficient structure for achieving this purpose.

6 Claims, 17 Drawing Sheets

VARIABLE VALVE TIMING MECHANISM

CROSS-REFERENCE TO RELATED APPLICATION

This application is a division of our application of the same title, Ser. No. 08/630,281, filed Apr. 11, 1996 and assigned to the assignee hereof.

BACKGROUND OF THE INVENTION.

This invention relates to a variable valve timing mechanism for a reciprocating machine and more particularly to an improved arrangement for permitting the control of variable valve timing and especially for engines having multiple controlled valves.

In many types of reciprocating machines such as internal combustion engines, valves are employed for controlling the flow to and/or from the variable volume chamber of the machine. These valves are normally operated in timed relationship to the output or driving shaft of the machine so that the valves open and close at particular portions in the cycle of operation.

With these types of machines, and particularly with internal combustion engines, the timing of valve opening and closing in order to obtain optimum performance varies in response to other operating parameters. For example, with internal combustion engines and the intake valves thereof, it is desirable under high-speed, high-load conditions to maintain a long period when the valve is in an open condition and a rapid rate of opening and closing in order to improve volumetric efficiency and increase the engine power output. However, such valve timings provide generally poor running under low-speed, low-load conditions.

The reason for this is that in order to obtain maximum power output, it is desirable to charge the combustion chamber with the maximum amount of charge possible. However, when running at low speeds and low loads, such long valve opening intervals and high valve lifts tend to cause a very sluggish air flow into the combustion chamber. This results in very low turbulence and slow flame propagation. Hence, total combustion may not occur.

In addition to these difficulties, there is also the consideration of the timing of the events of the intake valves relative to the exhaust valves. Overlap between the opening of the intake valve with respect to closing of the exhaust valve can assist in providing maximum power output. However, these long overlaps provide extremely rough running under low-speed, low-load conditions.

In order to provide more flexibility in engine performance, a wide variety of variable valve timing mechanisms have been proposed for engines. These mechanisms take a number of forms and, for the most part, are effective to shift the timing of the valve events. That is, the duration of the opening of the respective valve is maintained constant in some of these mechanisms, but the time of opening and closing is changed. This therefore requires considerable compromise in engine performance and performance of the variable valve timing mechanism, although it has the basic advantage of simplicity.

Other types of mechanisms have been provided that permit both the timing and the duration of valve opening to be changed. These mechanisms, however, become quite complicated.

It is, therefore, a principal object of this invention to provide an improved valve operating mechanism for a reciprocating machine where wide latitudes of changes in valve operation, both in the form of timing and lift, can be achieved.

It is a further object of this invention to provide an improved and simplified variable valve timing mechanism that permits both lift, timing, and duration to be adjusted, if desired.

The types of variable valve timing mechanisms that have been employed for varying the lift of the valve have normally interposed some form of mechanism between the camshaft and the valve, and adjusted the position of this element in some manner in order to vary the lift. With this type of device, however, the amount of variation in the lift is limited, and its timing is generally fixed because the shape of the cam lobe is not changed, and only the interconnection is changed.

It is, therefore, a still further object of this invention to provide a valve actuating mechanism for a reciprocating machine wherein a larger latitude of valve lift and valve timing are permitted.

It is a further object of this invention to provide a valve actuating mechanism for an engine that employs two separate cam lobes, each of which operates the same valve through a different mechanism to give wider latitude in variations in valve timing and/or lift.

With the types of mechanisms conventionally utilized for this purpose, it is also necessary to provide an actuator for actuating the mechanism that effects the variation in valve timing and/or lift. In addition, the mechanism that achieves these changes must be individual for each valve. This further complicates the overall engine construction.

It is, therefore, a still further object of this invention to provide an improved and simplified variable valve timing mechanism for a reciprocating machine that minimizes the number of parts required to effect the adjustments.

It is believed apparent from the foregoing description that the mechanisms previously used for this purpose tend to become quite complicated. Furthermore, when the engine is provided with multiple cylinders and/or multiple controlled valves, then the systems tend to become even more complicated.

It is, therefore, a still further object of this invention to provide an improved variable valve timing mechanism for a multiple-valve engine wherein the variable valve timing mechanism between at least adjacent cylinders is, in part, shared so as to minimize the number of components required.

SUMMARY OF THE INVENTION

A first feature of the invention is adapted to be embodied in a valve operating mechanism for a reciprocating machine comprised of a poppet valve supported for reciprocation. A camshaft is supported for rotation about an axis and has first and second cam portions, each associated with the poppet valve. Operating means provide a mechanical connection between selected ones of the cam portions and the poppet valve for controlling the position of the poppet valve in response to rotation of the camshaft. The cam portions and operating means cooperate with the poppet valve for providing different lift characteristics for the poppet valve, depending upon which of the cam portions controls the position of the poppet valve.

Another feature of the invention is also adapted to be embodied in a valve operating mechanism for a reciprocating machine that includes a poppet valve supported for reciprocation along a reciprocal axis. A camshaft is rotatable about a rotational axis and has first and second cam lobes juxtaposed to the poppet valve. The first cam lobe is associated with the poppet valve for direct operation of the poppet valve. A follower is associated with the second lobe for indirect actuation of the poppet valve through the follower. Means are provided for selecting which of the cam lobes operates the poppet valve.

A further feature of the invention is also adapted to be embodied in a valve operating mechanism for a reciprocating machine that has first and second poppet valves, each supported for reciprocation about respective reciprocal axes. First and second cam and followers are each associated with a respective one of the poppet valves for controlling the position of the poppet valves. Each of the cam and followers is movable between first and second relative positions for effecting different lift characteristics of the respective actuated poppet valve. An actuator is provided for moving the first and second cam followers between their first and second relative positions in a sequence so that one of the cam and followers is moved between its first and second positions before the other of the cam and followers.

A still further feature of the invention is also adapted to be embodied in a valve operating mechanism for a reciprocating machine. The machine is comprised of first and second poppet valves, each supported for reciprocation along a respective reciprocal axis. A camshaft has first and second cam portions, each juxtaposed to a respective one of the first and second poppet valves. First and second rocker followers are each supported about a pivot axis on the same rocker arm shaft. The first and second rocker arms are interposed between the first and second cam portions and the first and second poppet valves for actuating the poppet valves. The rocker arms are movable along the rocker arm shaft between first and second positions along the rotational axis for effecting different lift curves of the respective poppet valves. A coil spring surrounds the rocker arm shaft and is engaged with the first and second rocker arms for urging each of the rocker arms to its respective first position. An actuating device is provided for moving the rocker arms to their respective second positions and for compressing the coil spring.

BRIEF DESCRIPTION OF THE DRAWINGS

FIG. 9 is a four-part view, in part similar to. FIG. 8, and shows the condition when transitioning from low-speed, low-load condition to high-speed, high-load condition and has the same four portions as aforedescribed.

DETAILED DESCRIPTION OF THE PREFERRED EMBODIMENTS OF THE INVENTION

Figure 1:
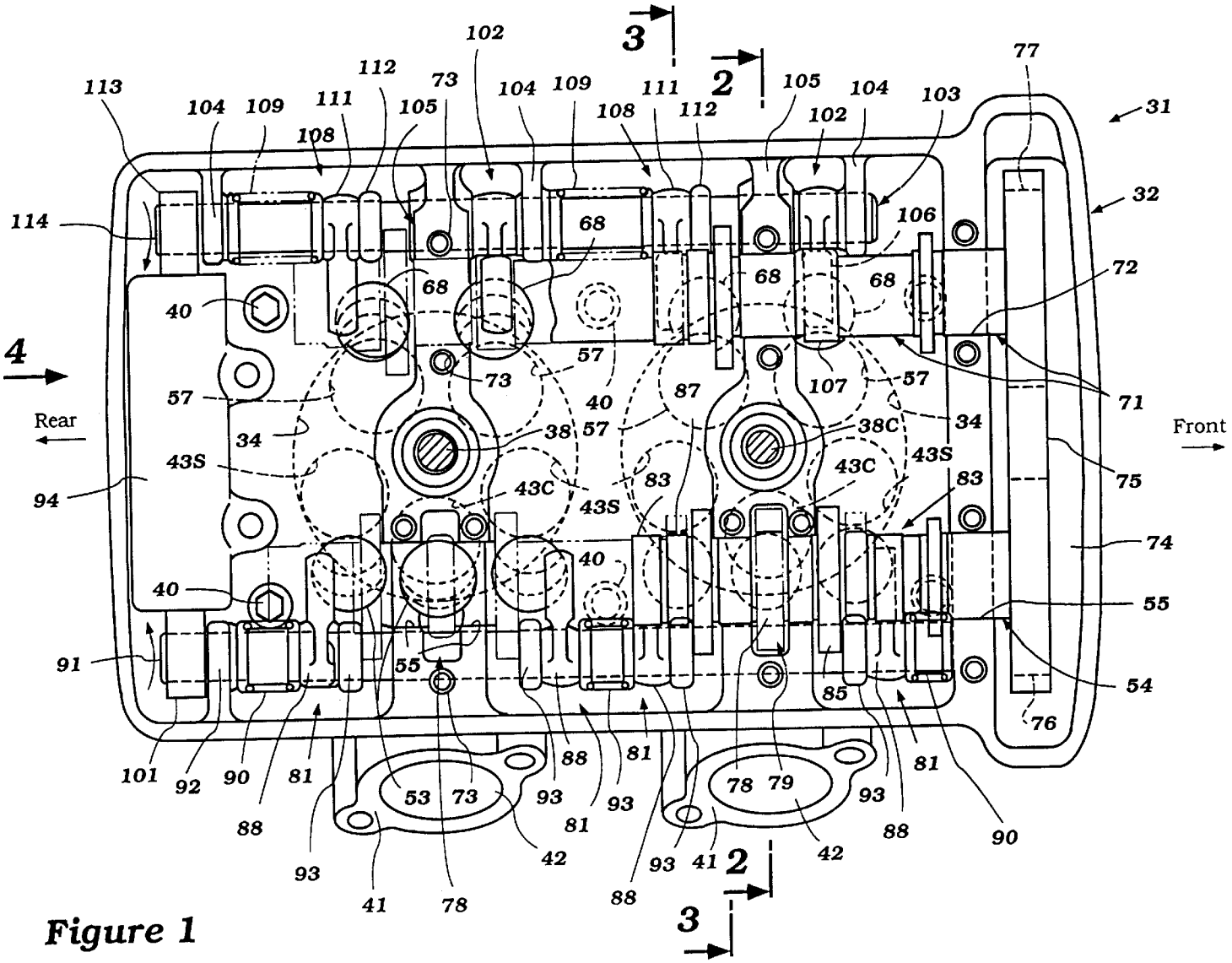
FIG. 1 is a top plan view of an internal combustion engine constructed in accordance with an embodiment of the invention and shows primarily the cylinder head assembly with the cam cover, induction, and exhaust systems removed.

Referring now in detail to the drawings, and first to the embodiment of FIGS. 1–10, an internal combustion engine constructed in accordance with this embodiment is shown partially and is identified generally by the reference numeral 31. Since the invention deals primarily with the valve and valve actuating mechanism of the engine 31, the invention will be described by primary reference to the cylinder head assembly for the engine, which is indicated generally by the reference numeral 32. The association of the cylinder head 32 with the remainder of the engine will be described by primary reference to FIGS. 1–3.

Figure 2:
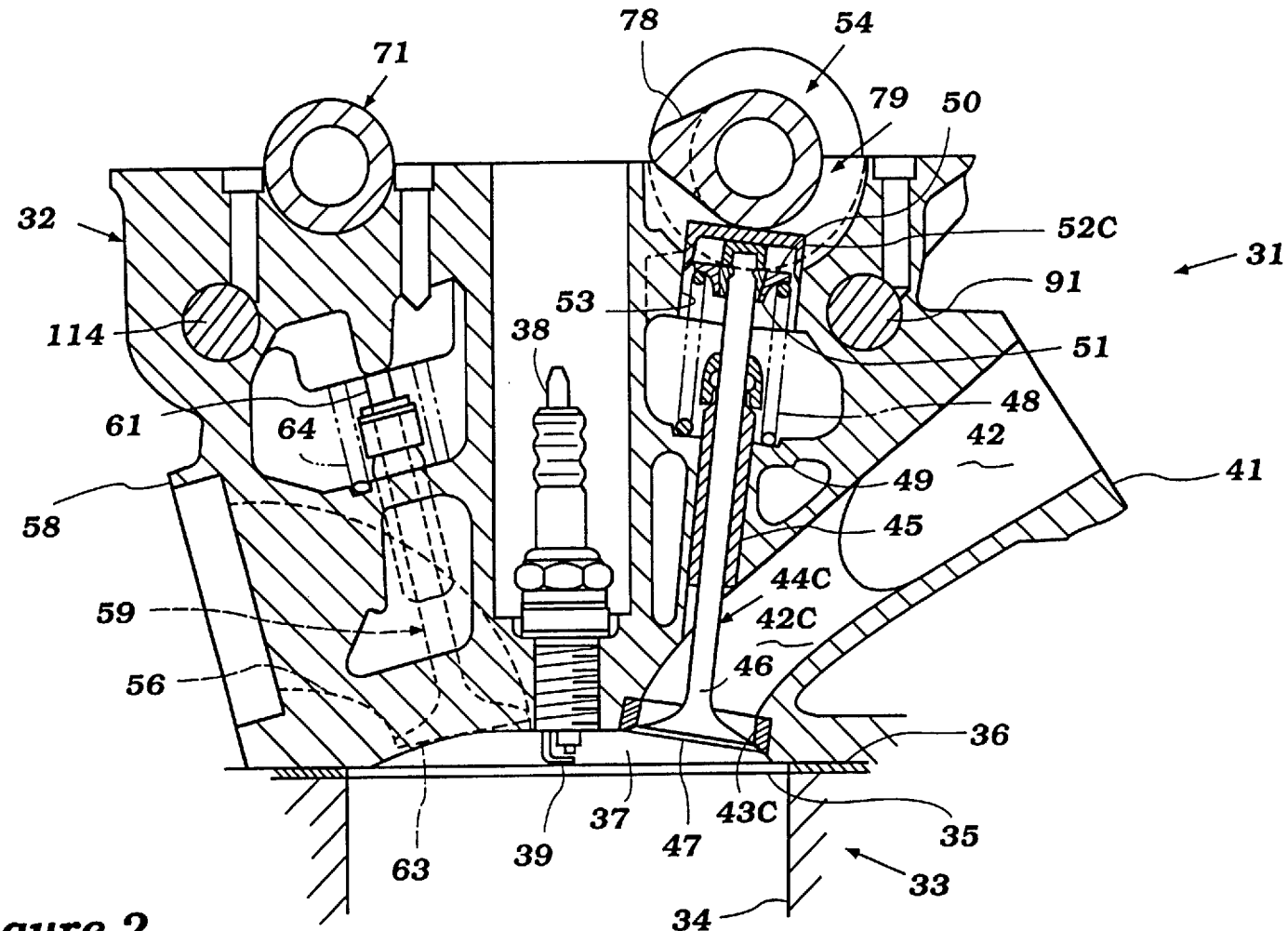
FIG. 2 is a cross-sectional view taken along the line 2—2 of FIG. 1.
Figure 3:
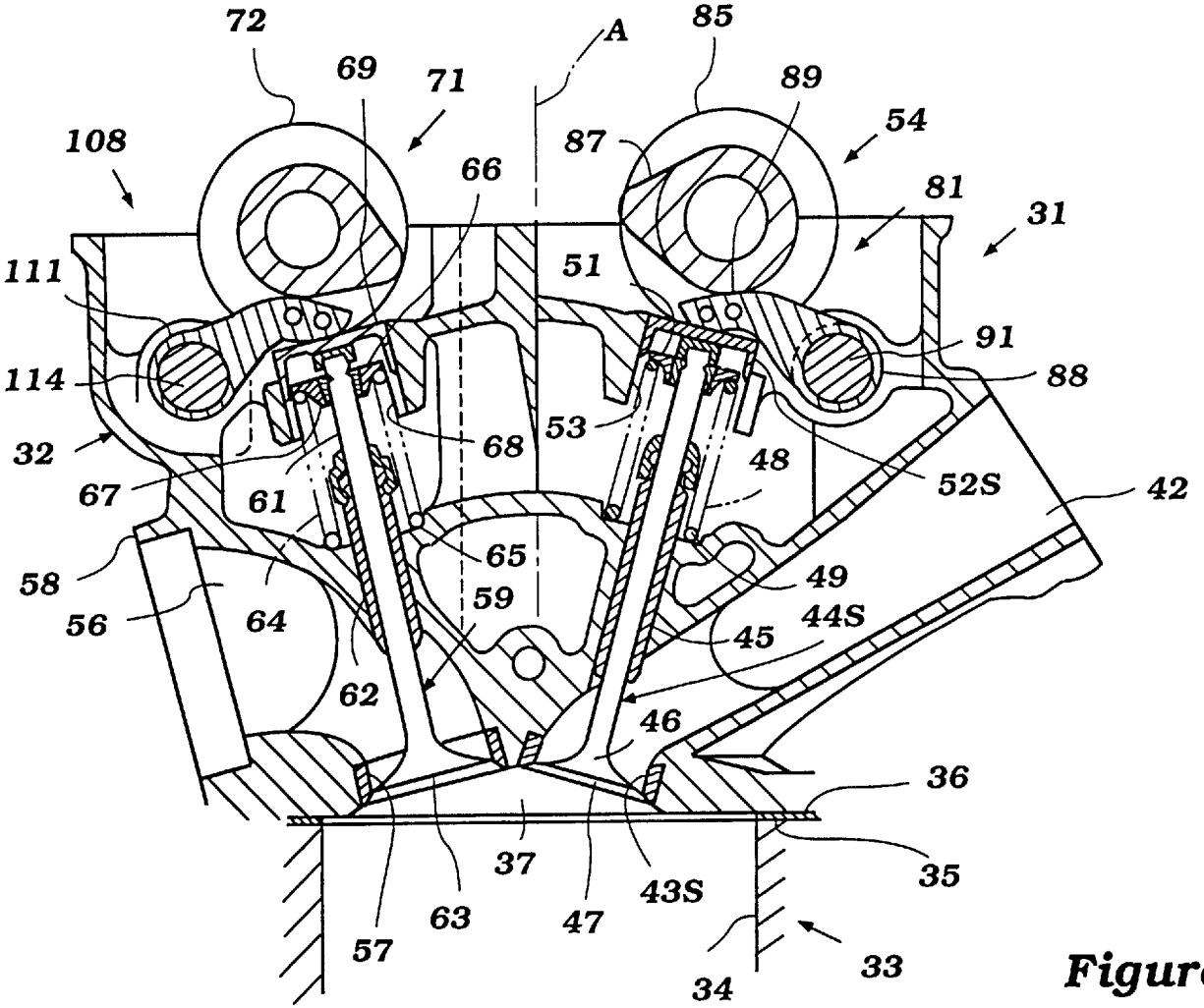
FIG. 3 is a cross-sectional view taken along the line 3—3 of FIG. 1.

As seen in FIGS. 2 and 3, the engine 31 is comprised of, in addition to the cylinder head 32, a cylinder block, indicated generally by the reference numeral 33. The cylinder block 33 has one or more cylinder bores, and in the illustrated embodiment there are two such cylinder bores, indicated by the reference numeral 34. The cylinder bores 34 may be formed directly in the cylinder block 33 or may be formed by liners pressed, cast, or plated therein. Because of the fact that the invention deals primarily with the valve and valve actuating system, this portion of the engine is not depicted in any greater detail.

Also, the invention is described in these figures by reference to a two-cylinder in-line engine. The cylinder head 32 may, however, comprise one bank of a V4 type of engine. Alternatively, other cylinder numbers and other cylinder configurations may be employed in conjunction with the invention. These variants will be readily obvious to those skilled in the art.

Pistons (not shown) are slidably supported in the cylinder bores 34 and are connected in a known manner to an associated crankshaft. This crankshaft rotates about an axis that extends perpendicularly to the plane of FIGS. 2 and 3, and which passes generally through the center of the cylinder head assembly 32, as shown in FIG. 1.

In the illustrated embodiment, the cylinder head assembly 32 is depicted as being formed primarily from a single-piece casting which may be formed from aluminum, aluminum alloy, or any other material, as known in this art. In addition to primarily single-piece cylinder head assemblies, the invention may also be employed in conjunction with built-up cylinder head assemblies.

The cylinder head 32 has a lower sealing surface 35 that is adapted to be held in abutting and sealing relationship with the cylinder block 33, and a cylinder head gasket 36 may be interposed therebetween for sealing purposes. Head bolts 40 maintain this sealing engagement. The surface 35 is formed with recesses 37 which overlie the cylinder bores 34 and form with them and the pistons the combustion chambers of the engine. As is well known in the art, the volume of these chambers varies cyclicly as the pistons reciprocate.

It should also be noted that a portion of the cylinder head surface 35 may also be in confronting relationship with the cylinder bore 34. This is done, if desired, to provide a squish action.

Spark plugs 38 are mounted in the cylinder head 32, with their spark gaps 39 extending into the cylinder head recesses 37. In the illustrated embodiment, the spark plugs 38 are centrally positioned so that the spark gap 39 lies generally on the axis of the associated cylinder bore 34. The spark plugs 38 are fired by any suitable type of ignition system.

An intake charge is delivered to the combustion chambers 37 (the reference numeral 37, which is primarily the cylinder head recess, will be referred to also as the combustion chamber, since at top dead center it forms the major volume of the combustion chamber). This charge is delivered from a charge-forming and induction system, which is not shown, but which is adapted to be detachably connected to an outer surface 41 of the cylinder head 32. This induction and charge-forming system cooperates with intake passages 42 formed in the cylinder head 32 and which open through the surface 41. The invention is described in conjunction with an engine having a Siamese-type multiple-valve arrangement.

It should be understood that certain facets of the invention may be employed with engines having non-Siamese-type intake passages. In any event, the intake passage 42 branches into a pair of side portions 42S, each of which terminates at a respective side intake valve seat 43S. There is further provided a center intake passage portion 42C (FIG. 2) which terminates at a center intake valve seat 43C.

As may be best seen in FIG. 1, although this structure also is in FIGS. 2 and 3, the side intake valve seats 43S are disposed so that they are close to or lie in part on a plane that contains the axis of rotation of the crankshaft and also the axis of the cylinder bores 34. The center intake valve seat 43C is disposed between the side intake valve seats 43S and further from the aforenoted plane. The specific orientation of the valve seats may be chosen to suit the particular engine application.

Poppet-type intake valves 44 are slidably supported in the cylinder head 32 for reciprocation along reciprocal axes defined by valve guides 45. These valve guides 45 are pressed or cast into the cylinder head 32 in a known manner. Each intake valve 44 has a stem portion 46 that is slidably supported in the guide 45 and which is connected to a head portion 47 which forms a valving function with a valve seat surface formed by the valve seats 43 in a manner well known in the art.

As may be recognized from FIGS. 2 and 3, the axis of reciprocation of the center intake valve 44C is disposed at a greater angle to a plane containing the cylinder bore axis, which appears at A in FIG. 3 than the side intake valves 44S. The axes of reciprocation of the side intake valves 44S are in the same plane, which is at a smaller angle than the axis of the plane containing the center intake valve 43C. Although this orientation is preferred, it will be readily apparent to those skilled in the art how the invention may be utilized with valves having different orientations.

Each of the intake valves 44 is urged to its closed position by a respective coil compression spring 48. The coil spring 48 acts against a machined surface 49 formed in the cylinder head 32 around the valve guide 45. The opposite ends of the springs 48 act against spring retainers 50 that are held to the stems 46 of the valves 45 by keepers 51 in a manner well known in this art. Each valve 44 is operated via a thimble tappet 52 which is slidably supported in a bore 53 formed in the cylinder head. The thimble tappet associated with the center intake valve is indicated at 52C, while those associated with the side intake valves are indicated at 52S.

The intake valves 44 are operated by an overhead-mounted intake camshaft 54 in a manner which will be described in more detail later by reference to the remaining figures. It should be noted, however, that in the illustrated embodiment, the axis of rotation of the intake camshaft 54 is disposed so that the axes of reciprocation of the intake valves 44 will pass through its center. Although this is not essential, it is a preferred arrangement.

The cylinder head 32 is performed with a plurality of bearing surfaces 55, which are complementary to and rotatably journal the intake camshaft 54 about the aforenoted axis. Bearing caps (not shown) are affixed to the cylinder head 32 and cooperate with these bearing surfaces 55 so as to rotatably journal the intake camshaft 54 in a manner generally well known in this art.

On the side of the cylinder head 32 opposite the aforenoted plane containing the cylinder bore axis A, there are formed a pair of exhaust passages 56. The exhaust passages 56 may be individual or paired in Siamese fashion and extend from valve seats 57 formed in the cylinder head to an exhaust manifold (not shown) that is attached to an outer surface 58 of the cylinder head 32 in a known manner. Each of the exhaust valve seats 57 is valved by a respective poppet-type exhaust valve 59. Like the intake valves 54, the exhaust valves 59 have stem portions 61 that are slidably supported in valve guide 62, pressed or cast into the cylinder head 32 in any manner known in the art. The exhaust valves 59 have head, portions 63 that cooperate with seating portions formed in the valve seats 57 in a known manner.

Each of the exhaust valves 59 is urged to a closed position by means of a respective coil compression spring 64. The springs 64 act at one end against machined surfaces 65 formed on the cylinder head 32 around the valve guide 62. The opposite ends of the springs 64 act against spring retainers 66 that are fixed to the stems of the exhaust valves 59 by keeper assemblies 67.

The cylinder head 32 is formed with bores 68 that slidably receive thimble tappets 69. The thimble tappets 69 are actuated by an exhaust camshaft, indicated generally by the reference numeral 71, and which is journaled on the exhaust side of the cylinder head 32.

The journaling of the exhaust camshaft 71 is provided by machined bearing surfaces 72 formed in the cylinder head 32 and which cooperate with corresponding bearing surfaces formed on the exhaust camshaft 71. This type of bearing arrangement is well known, and further includes bearing caps (not shown) that are held in place by threaded fasteners. The threaded fasteners for the bearing caps for both the intake camshaft 54 and exhaust camshaft 71 are indicated by the reference numeral 73 in certain of the figures, and specifically FIG. 1.

The intake and exhaust camshafts 54 and 71 are driven by a timing drive that is contained within a chain or belt case 74 that is formed in part in the front of the cylinder head 32. In the illustrated embodiment, this drive is comprised of a drive belt or chain 75 that is driven by the crankshaft of the engine, either directly or through an intermediate drive. This chain or belt 75 cooperates with sprockets 76 and 77 that are fixed to the forward ends of the camshafts 54 and 71 in a known manner. The camshafts 54 and 71 are driven at one-half crankshaft speed, as is well known in this art. If desired, the drive for the camshafts 54 and/or 71 may include a variable timing mechanism of any known type.

However, such an arrangement is not necessary in view of the valve actuating mechanism which will be described. However, it will be apparent to those skilled in the art how the valve actuating mechanism which will be described can be utilized in conjunction with a variable valve timing mechanism so as to further enhance the engine performance.

In this embodiment of the invention, one of the intake valves, the center intake valve 44C is operated directly through its thimble tappet 52C by a first, center cam lobe 78 formed on the intake cam shaft 54. Hence, the operation of the center intake valve 44C is maintained substantially constant during the entire engine load and speed ranges in this embodiment. This direct valve actuating structure is indicated generally by the reference numeral 79 and basically operates like a conventional directly operated valve arrangement of an overhead cam shaft engine. It has been noted, however, that a variable valve timing mechanism may be employed in conjunction with the drive for the intake cam shaft 54 and if such a variable valve timing mechanism is employed, then the timing of the opening and closing of center intake valve 44C may be varied.

Figure 5:
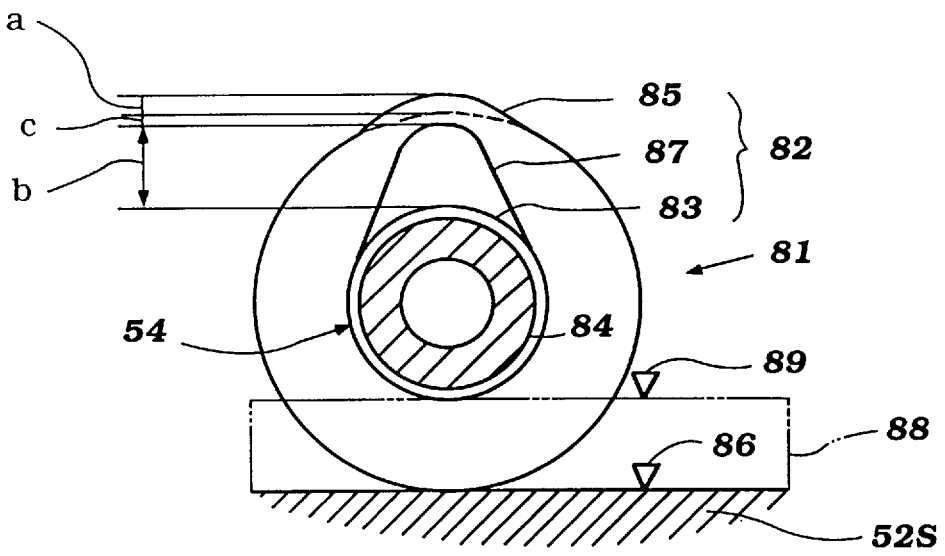
FIG. 5 is an enlarged cross-sectional view showing the cam lobes associated with one of the intake valves.

On the other hand, the side intake valves 44S in this embodiment are indirectly actuated by a variable lift mechanism, indicated generally by the reference numeral 81 and which has a construction which is best shown in FIGS. 1, 3, and 5 through 10. Referring initially primarily to FIG. 5 the mechanism 81 and specifically the cam shaft 54 is provided with in essence three portions each of which may be considered to be a cam portion. These three portions are indicated generally by the reference numeral 82 and are comprised of a no lift cam portion 83 which extends slightly beyond the base diameter 84 of the intake cam shaft 54. This section 83 is completely cylindrical and is coaxial with the axis of rotation of the intake cam shaft 54 so that it in essence provides no lift for the side intake valves 44S when in a first running condition.

However, the cam lobe portions 82 also include a low-speed/low-load cam lobe 85 that has a lift dimension a which is the difference between its base circle diameter and the upper portion of the lobe 85. The lobe 85 is positioned so that it will be in direct engagement with the head surface 86 of the individual tappet bodies 52S. Hence, under low-speed/low-load conditions, the cam lobe 85 will provide a relatively small lift to the side intake valves 44S. Under this condition, the primary intake charge will be delivered to the engine combustion chamber 37 through the center intake passage portion 42C and the center intake valve 44C.

Finally, for high-speed/high-load running, there is provided a high-speed cam lobe 87 which has a base diameter the same as the diameter of the no-lift lobe 83 but which has a lift b as seen in FIG. 5 which is substantially greater than the lift a provided by the low-speed cam lobe 85. In order to accomplish opening of the side intake valves 44S from the cam lobe 87, there is provided a follower in the form of a rocker arm element 88, one for each of the side intake valves 44S. The way in which the rocker arm 88 is operated will be described shortly but it has an upper surface 89 that is contacted by the nose of the cam lobe 84 for operating it.

It should be seen that the base circle of the low-speed cam lobe 85 is spaced outwardly a distance c beyond the cam lobe 87 of the high speed cam and hence the cam lobe 87 will never contact the thimble tappet 52*s*.

Referring now primarily to FIGS. 1 and 6–10, it will be seen each of the rocker arms 88 is slidably supported and pivotable about a rocker arm shaft 91. The rocker arm shaft 91 is mounted in fixed relationship axially in the cylinder head 32 on a plurality of bosses 92 formed therein. The rocker arms 88 are normally urged by means of coil compression springs 90 into engagement with a stopper ring 93. The stopper ring 93 is supported for reciprocation relative to the rocker arm shaft 91 and is held against rotation relative to the cylinder head 32 by a retainer pin 94 that is received in a longitudinally extending slot 95 formed in the cylinder head 32.

A pair of cam actuating grooves 96*a* and 96*b* are associated with adjacent rocker arms 88 of adjacent cylinders. That is, with this arrangement only a single coil spring 90 is positioned between the two rocker arms 88 associated with number 1 and number 2 cylinders as shown best in FIG. 1. A single spring 90 operates against the remaining valve and bears against a fixed abutment formed on the cylinder head 32.

Each of the cam slots 96*a* is comprised of a first low-speed portion 97*a* and 97*b* and a second high-speed portion 98*a* and 98*b*. The pins 94 are received in these slotted portions. By rotating the rocker arm shaft 91 in the directions indicated by the arrow B it is possible to effect reciprocation of the pins 94 and their associated stopper rings 93 in a manner as will be described. It should be noted that the length of the slots 97*a* and 97*b* in the circumferential direction is the same as each other while the length of the slots 98*a* and 98*b* in the circumferential direction is the same as each other but longer than the length of the slots 97*a* and 97*b*.

Also, the axial length l of each of the slots 96*a* and 96*b* is the same. Because of the configuration for a single rotation through the angle B, one stopper ring 93 is moved between its high and low-speed positions before the other is moved but upon total rotation through the arc B both will be moved in this direction. This accommodates the different cam timing between the cam shafts, as will become apparent, and also reduces the actuating loading.

Figure 4:
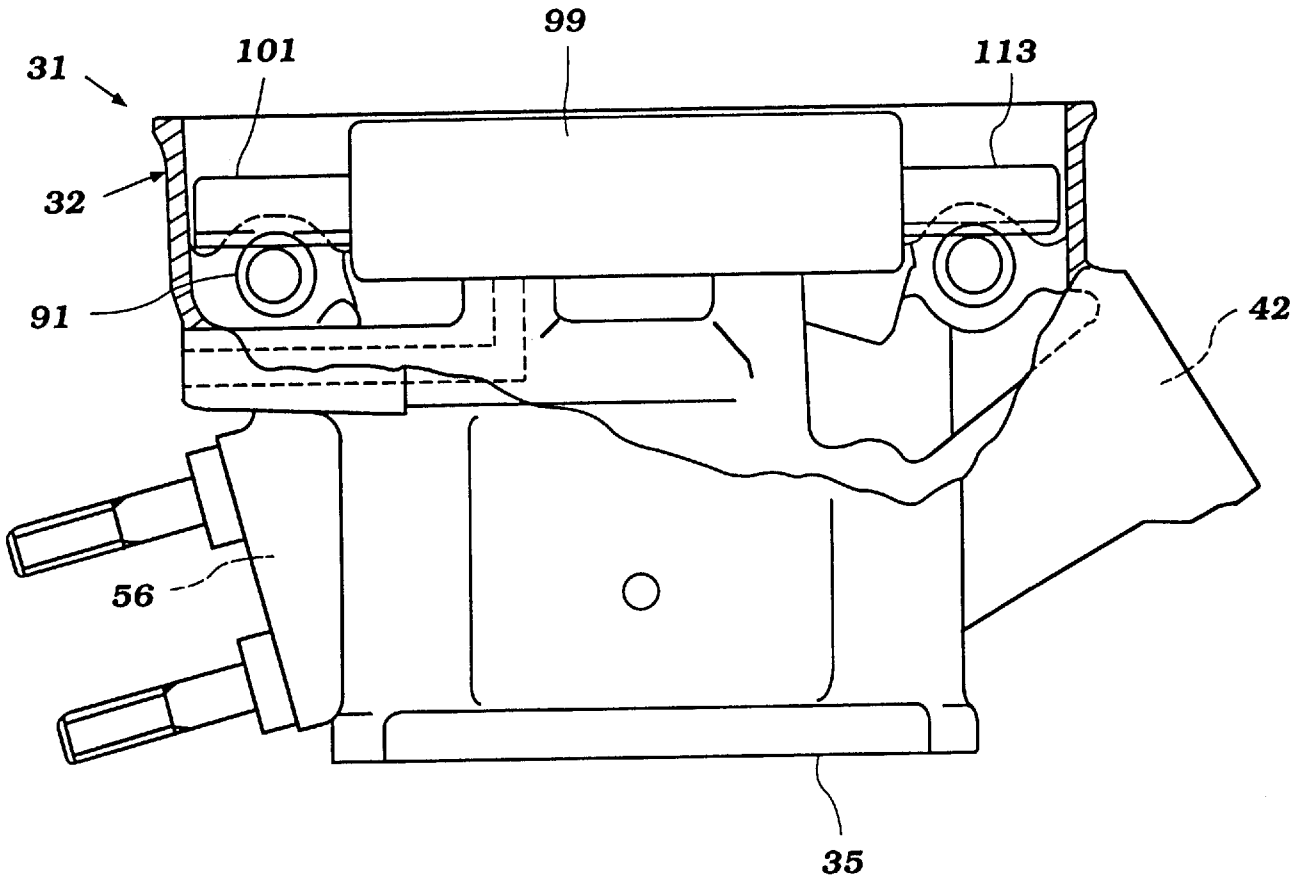
FIG. 4 is a view of the cylinder head looking generally in the direction of the arrow 4 in FIG. 1, with a portion of the cylinder head broken away so as to more clearly show the arrangement for the support of the rocker arm shafts and adjustment of the rocker arms.

The mechanism for rotating the rocker arm shaft 91 and the apparatus therefor is shown best in FIGS. 1 and 4. This includes a servomotor 99 that operates a pair of racks, one associated with the intake rocker arm shaft 91 and indicated by the reference numeral 101 and the other of which is associated with the exhaust rocker arm shaft, yet to be described. The ends of the rocker arm shafts are provided with gear teeth so that when the servomotor 99 is actuated there will be effected rotation of the rocker arm shafts through the angle B.

FIGS. 1–8 basically show the condition when the engine is operating at a low-speed/low-load condition. In this condition, the rocker arm shaft 91 is rotated to the extreme left-hand direction so that the pins 94 are engaged at the ends of the respective slot portions 97*a* and 97*b*. As a result, the coil compression springs 90 will urge the rocker arms 88 into engagement with the stopper members 93. As a result, the rocker arm 88 in this position will be held in registry with the cam shaft low-speed/low-load nonlift load portion 83 and the rocker arm 88 will not be pivoted. Rather, the low-speed/low-load cam lobe 85 will be engaged with the surfaces 86 of the side intake valve tappets 52S and they will be held clear of engagement with the high-speed cam load 87. As a result, the shape of the low-speed cam lobe 85 will control the degree and timing of the opening of the side intake valves 44S. Thus, these valves will be opened at only the relatively low lift.

Figure 6:
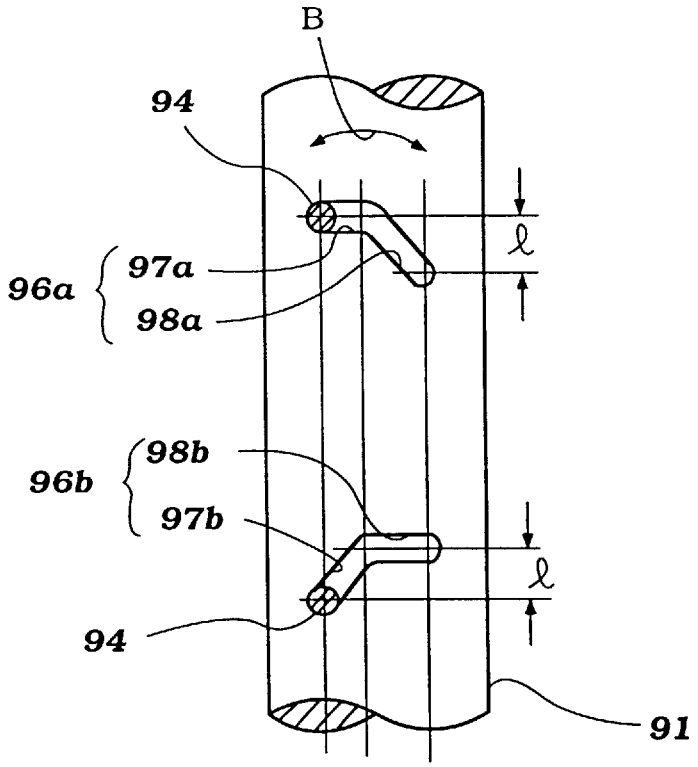
FIG. 6 is a view which is in part in cross-sectional form and which shows the mechanism for effecting the axial movement of the actuating rocker arms along the rocker arm shaft.
Figure 7:
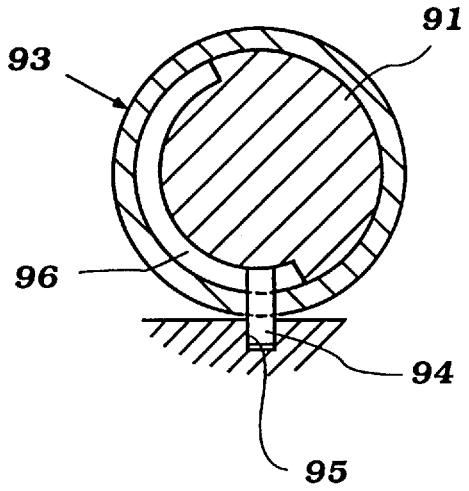
FIG. 7 is a cross-sectional view showing how the rocker arm shaft and axial movement control is effected.
Figure 8:
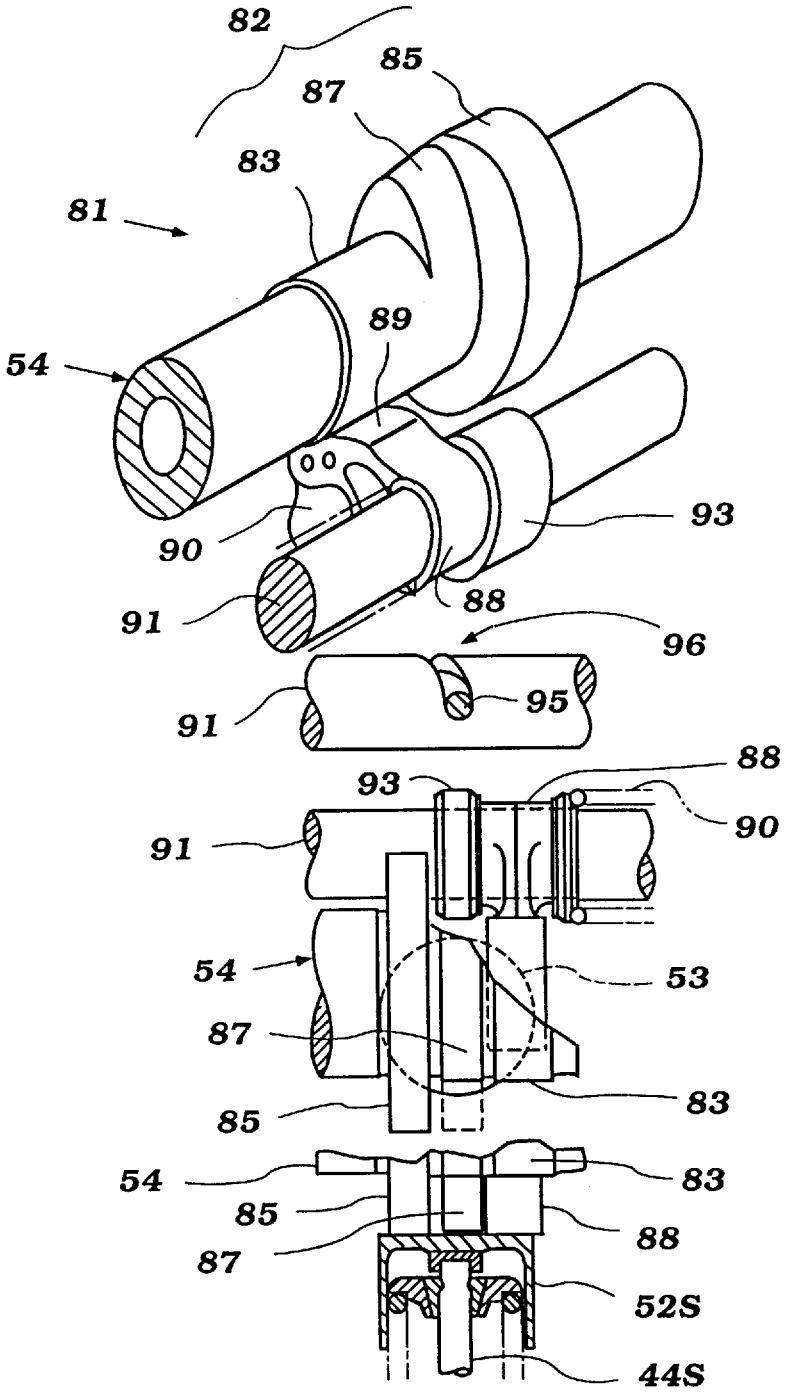
FIG. 8 is a four-part view showing the condition of the valve actuating mechanism when operating the low-speed, low-load conditions. The top view is a perspective view, the next view is a view showing the rocker arm actuating mechanism, the third view is a top plan view, and the lower view is a cross-sectional view taken through the valve stem and cam and follower arrangement.

As the engine moves into the high-speed/high-load condition, the rocker arm shaft 91 will be rotated through the angle B in a counterclockwise direction as shown in FIG. 6. This will effect first movement of the pin 94 along the slot portion 97*b* so as to axially move the stopper ring 93 from the position shown in FIG. 8 to the position shown in FIG. 9.

During this time, the remaining stopper ring 93 will not move axially because the slot 97*a* extends circumferentially. However, on continued movement, the remaining stopper ring 93 will be moved axially along the rocker arm shaft toward the stopper ring 93 which has been previously moved so that the spring 90 will be compressed. During this motion, the first stopper ring 93 will stay in its axial position.

The rocker arms 88, as have been noted, are freely axially movable along the rocker arm shaft 91. During the range of motion between FIGS. 8 and 9, these rocker arms 88 will contact the side of the cam lobe 87 and the stopper rings 93 will move away from them.

Figure 10:
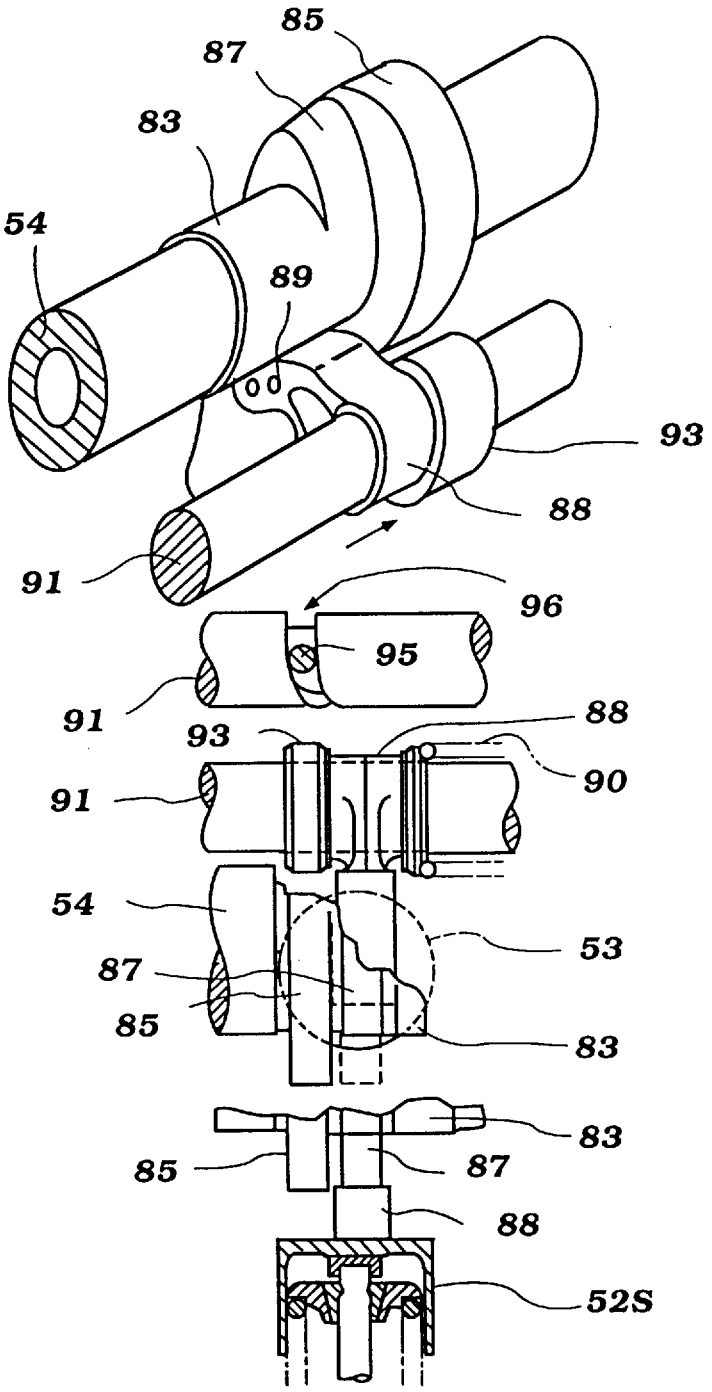
FIG. 10 is a four-part view, in part similar to FIGS. 8 and 9, and shows the final condition when operating at high-speed, high-load conditions.

However, the heel of the cam lobe 87 is of the same diameter as the no-lift low-speed cam lobe 83 and when this comes into registry, as seen in FIG. 10, then the springs 90 will complete their action and move the rocker arms 88 into registry of the cam lobe 87 so that its lift characteristics will control the lift of the side intake valve 44S.

Therefore, this mechanism permits the actual movement of the rocker arms to be accomplished by springs and causes a gradual transition without placing undue loads on the system. Also, the fact that one stopper 93 is moved before the other facilitates the transition.

It should be readily apparent that return from high-speed/high-load condition to low-speed/low-load condition is achieved in the opposite sense. However, when the stopper ring 93 is moved from the position shown in FIG. 10 toward the position shown in FIG. 8 the rocker arm 88 will actually be moved away from the cam lobe 87 since there is no positive stop to preclude such movement.

Referring now to the exhaust side and the mechanism for operating the exhaust valves 59, it should be noted that one of the exhaust valves 59 is actuated by a first rocker arm 102 which is basically fixed in axial position on an exhaust rocker arm shaft 103. This rocker arm 102 is captured between a boss 104 and a bearing boss 105 that journal the exhaust cam shaft 71. A follower portion 106 is interposed between the cam lobe 107 for this valve and hence this exhaust valve 59 is operated at all times and at full lift.

However, a variable lift mechanism 108 is provided for operating the remaining exhaust valve 59. This mechanism includes a coil compression spring 109 that acts against the rocker arm 111 to hold it into engagement with a stopper ring 112 that is operated in the manner previously described. The servomotor 99 has a further rack-like portion 113 that cooperates with a gear 114 formed on the end of the exhaust rocker arm shaft 103 so as to operate it in the manner described. Hence, with this embodiment when the engine is operating at low-speed/low-load, all valves will be opened and closed but only the center intake valve 44C and the one exhaust valve will be operated at their full lift. However, as the engine speed and load increases, then all valves will be operated at full lift.

Figure 11:
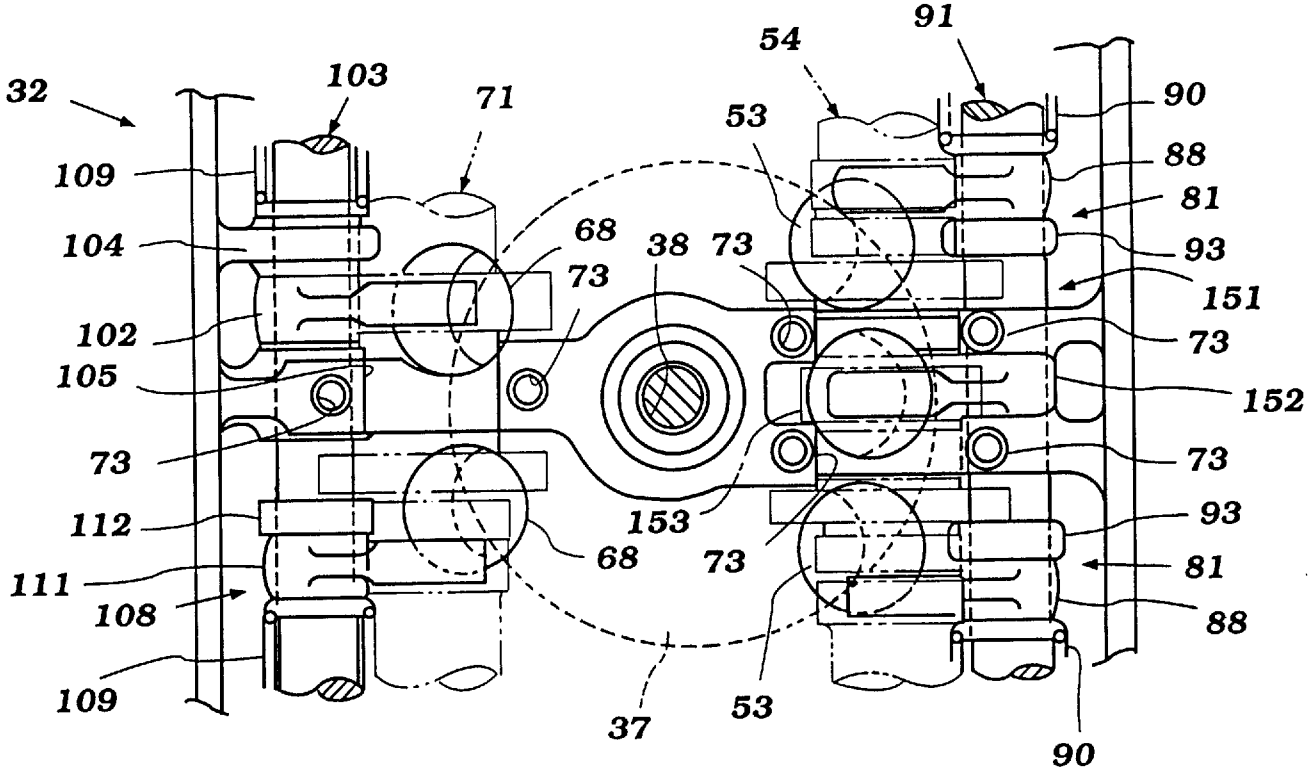
FIG. 11 is a partial top plan view, in part similar to FIG. 1, and shows another embodiment of the invention utilizing rocker arm followers for actuating all of the valves.
Figure 12:
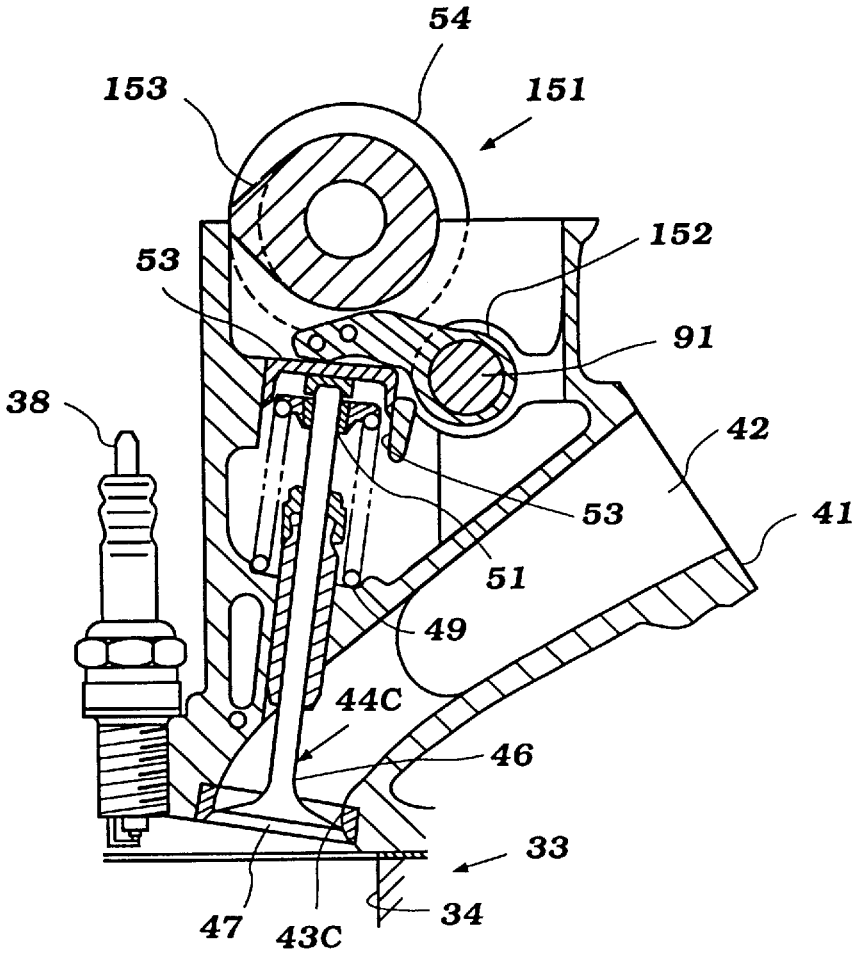
FIG. 12 is a partial cross-sectional view taken through the actuating mechanism for the center intake valve.

Thus, the engine provides high induction air flow velocities due to the small effective flow passages at low-speed and low-load. At high-speed and high-load, on the other hand, large effective passages are provided that will permit high air flows into the combustion chamber and hence high volumetric efficiency. The actual strategy by which the valves are controlled will be of any type suitable for the specific engine. In the embodiment as thus far described, one of the intake valves has been directly actuated. FIGS. 11 and 12 show another embodiment of the invention wherein this single center intake valve 44C is operated indirectly through a rocker arm mechanism, indicated generally by the reference numeral 151. This rocker arm mechanism 151 includes a rocker arm 152 that is supported in a fixed axial position on the intake rocker arm shaft 91 and is interposed between a center cam lobe 153 of the intake cam shaft 54. Aside from this difference, this embodiment is the same as that previously described and further description of it is not believed to be necessary to permit those skilled in the art to practice the invention.

In the embodiments as thus far described, the valves which are provided with the variable lift have been operated so that either primarily one intake valve operates under a low-speed, low-load conditions and all three valves operate under high-speed, high-load conditions. In addition, the rate of shifting between non-operational or dwell state and operational state and operational state and back to non-operational state has been substantially the same. In some instances, it may be desirable to shift from one to two and then to three intake valves being operational per cylinder and also so as to provide a mechanism whereby the rate of change between operational and non-operational occurs at a different time than that between non-operational back to operational.

Next will be described an embodiment wherein these results may be obtained. This embodiment is shown in FIGS. 13–18 and will be described by particular reference to those figures. Basically, the construction of the engine is the same and the center intake valve 44C may be operated either directly through the thimble tappet from the cam lobe or through a rocker arm as shown in the respective embodiments of FIGS. 1–10 and FIGS. 11 and 12. In a like manner, both exhaust valves may be operated by rocker arms with one of these rocker arms being configured so as to provide the variable lift as previously described. Thus, where components of this embodiment are the same or substantially the same as the previously described embodiment, they have been identified by the same reference numerals and will not be described again, except insofar as is necessary to understand the construction and operation of this embodiment.

Figure 13:
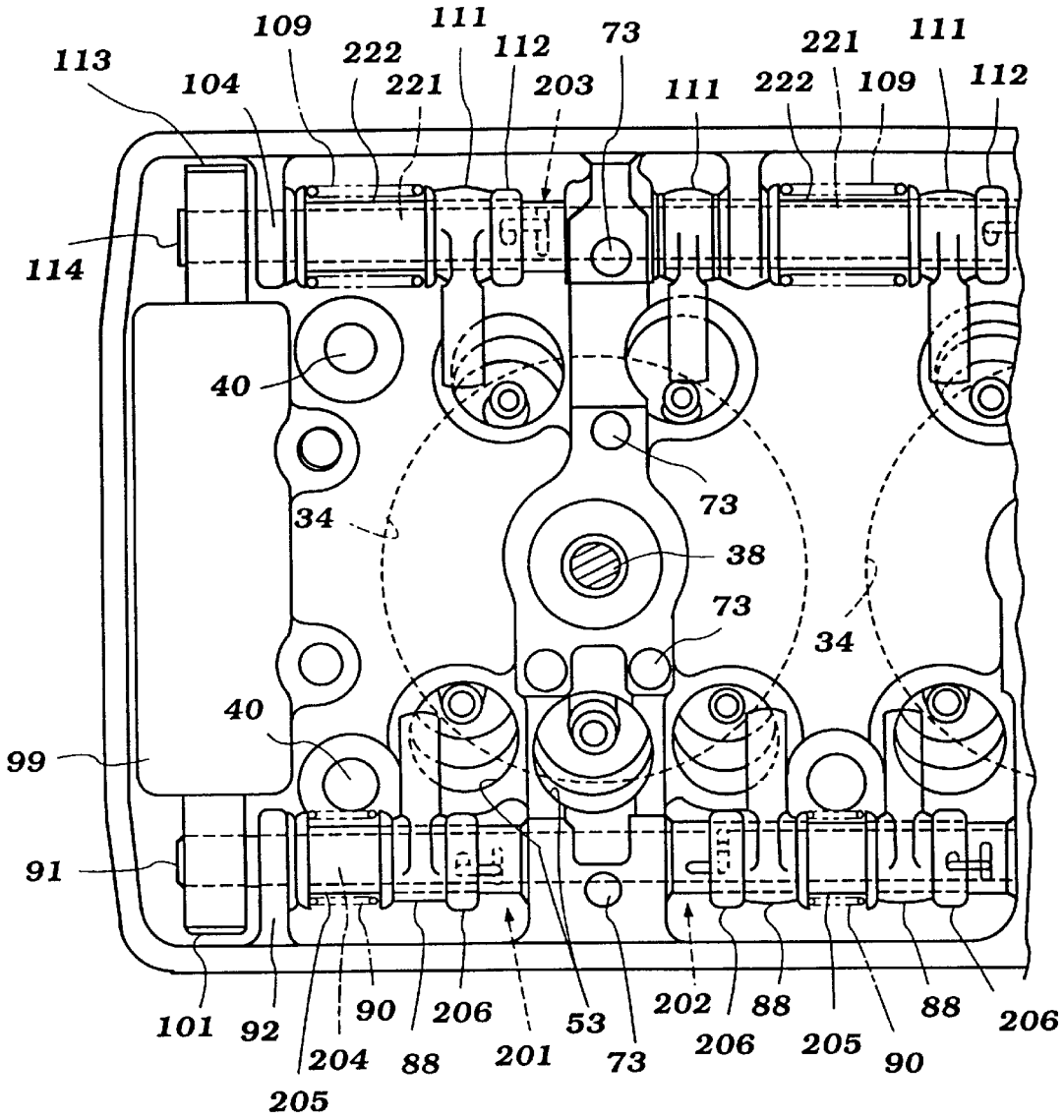
FIG. 13 is a partial top elevational view, in part similar to FIGS. 1 and 11, and shows another embodiment of the invention.

Since the only difference between this embodiment and the earlier embodiment is the valve actuating mechanism associated with the valves having variable timing only those components have been identified by new reference numerals and they will be described in detail. This includes a first actuating mechanism 201 indicated with the left-hand side intake valve as seen in FIG. 13 and the valve actuating mechanism 202 associated with the right-side intake valve. These valve actuating mechanisms are shown in more detail in FIGS. 14–17 and will be described by reference thereto.

Figure 18:
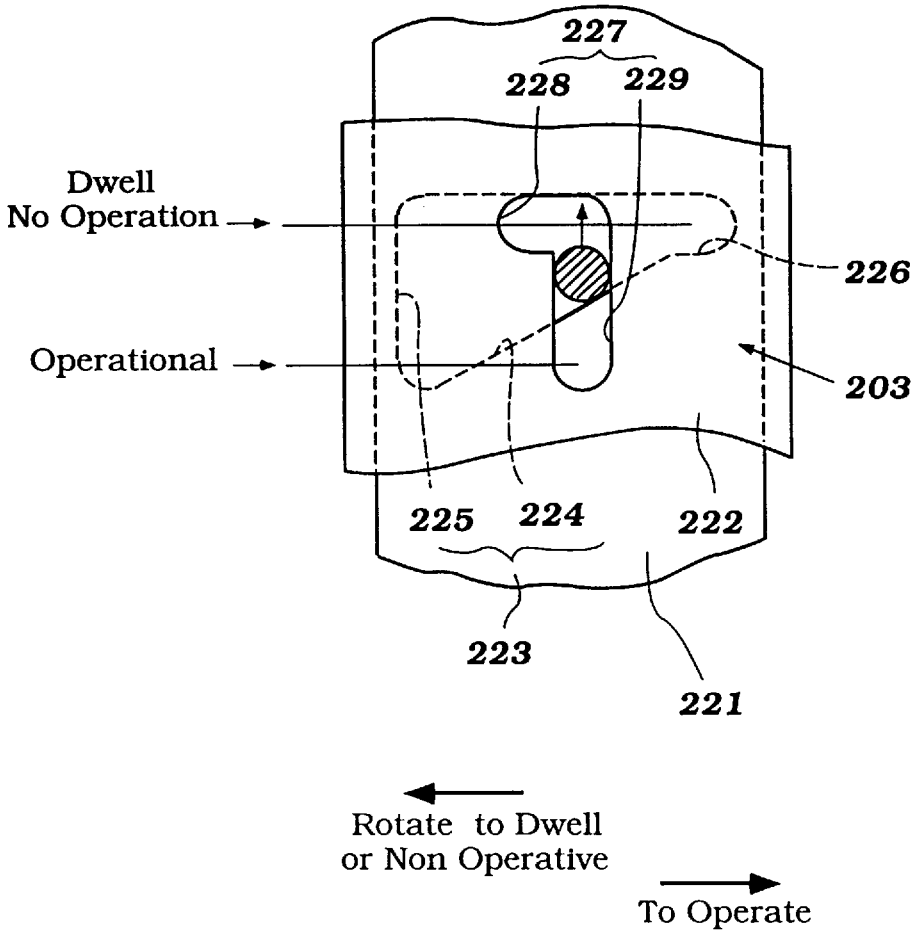
FIG. 18 is a diagrammatic developed view, in part similar to FIG. 14, and shows the operation of the exhaust valve.

The valve actuating mechanism associated with the one exhaust valve is indicated generally by the reference numeral 203 and that will be described by particular reference to FIGS. 18 and 19.

Referring first to the mechanisms associated with the side intake valves and particularly FIGS. 14–17, it will be seen that the rocker arm shaft in this embodiment is comprised of a rotatable, inner tubular member 204 and an outer fixed tubular member 205. The mechanism 99 for operating the inner shaft portion 204 is the same as the manner described in the previous embodiment.

As with the previously-described embodiments, there is further provided a stopper ring 206 is associated with each of the mechanisms 201 and 202 and which has a pin portion 207 that extends through slots therein and which is slidably supported in a longitudinally extending groove formed in the cylinder head 32, as with the previously-described embodiment.

Referring first to the mechanism 201, it includes a first slotted portion 208 which is formed in the outer rocker arm shaft portion 205 and a second slotted portion 209 that is formed in the inner rocker arm shaft portion 204. In a like manner, the mechanism 202 is comprised of an outer slotted portion 211 and an inner slotted portion 212 formed on the rocker arm shafts 205 and 204, respectively.

As will become apparent, the slotted portions 208 and 209 have a different configuration than the slotted portions 211 and 212 so as to permit additional lost motion upon relative rotation so that one of the intake valves may be actuated before the remaining side intake valve is actuated and vice versa. This also facilitates a different speed at which the number of operative valves is increased from that at which the operative number is decreased, as will become apparent.

The slotted portion 208 has a first part 208*a* which extends circumferentially and a second portion 208*b* which extends axially. In a like manner, the slotted portion 211 has a circumferentially extending first portion 211*a* and an axially extending second portion 211*b*. It should be noted that the length of the portions 208*b* and 211*b* is the same but the circumferential extent of the portion 208*a* is substantially less than that of the portion 211*a*.

The second groove 209 of the valve actuating mechanism 201 is provided with a triangular portion 213 having an inclined ramp 214. At the base of the ramp 214 there is provided an elongated circumferentially extending groove 215. As should be readily apparent, rotation of the inner shaft portion 204 relative to the outer shaft portion 205 from the position shown in FIG. 14 will effect no movement of the pin 207 along the slot portion 208*b* until the ramp 214 contacts the pin and cams it toward the slot portion 208.

The slot 212 of the cam actuating portion 202 is also formed with a triangular portion 217 having a ramp 218 and a relatively short circumferentially extending portion 219 formed at the base of the ramp 218. Again, the ramp 218 functions to move the pin 207 along the slot portion 211*b*. Hence, the ramp portions 214 and 218 are effective in order to cause the axial movement of the stoppers 206 toward and away from each other for cooperating with the springs 90 in effecting the movement of the respective cam followers between their operative and dwell or nonoperative positions.

The way in which the number of operative valves changes in response to changes in engine speed and load will now be described by particular reference to FIGS. 16 and 17. In these figures, the various actuating mechanisms 201 and 202 and specifically the system 201 for operating the left intake valve have been transposed from that of FIG. 14 for illustration purposes. Also, it is to be understood that the strategy by which the number of operative valves is determined may vary from engine to engine and may be measured by various parameters.

The illustrated embodiment deals primarily with a system that is responsive solely to engine speed and operates so that at high engine speeds all valves are operated, as the speed decreases, the number of intake valves employed is decreased and at low speeds only one intake valve is fully operative. The remaining valves may be either held in their closed positions or may have a slight lift as described in conjunction with the previous embodiment. This choice will be well within the scope of those skilled in the art having this information available.

Figure 14:
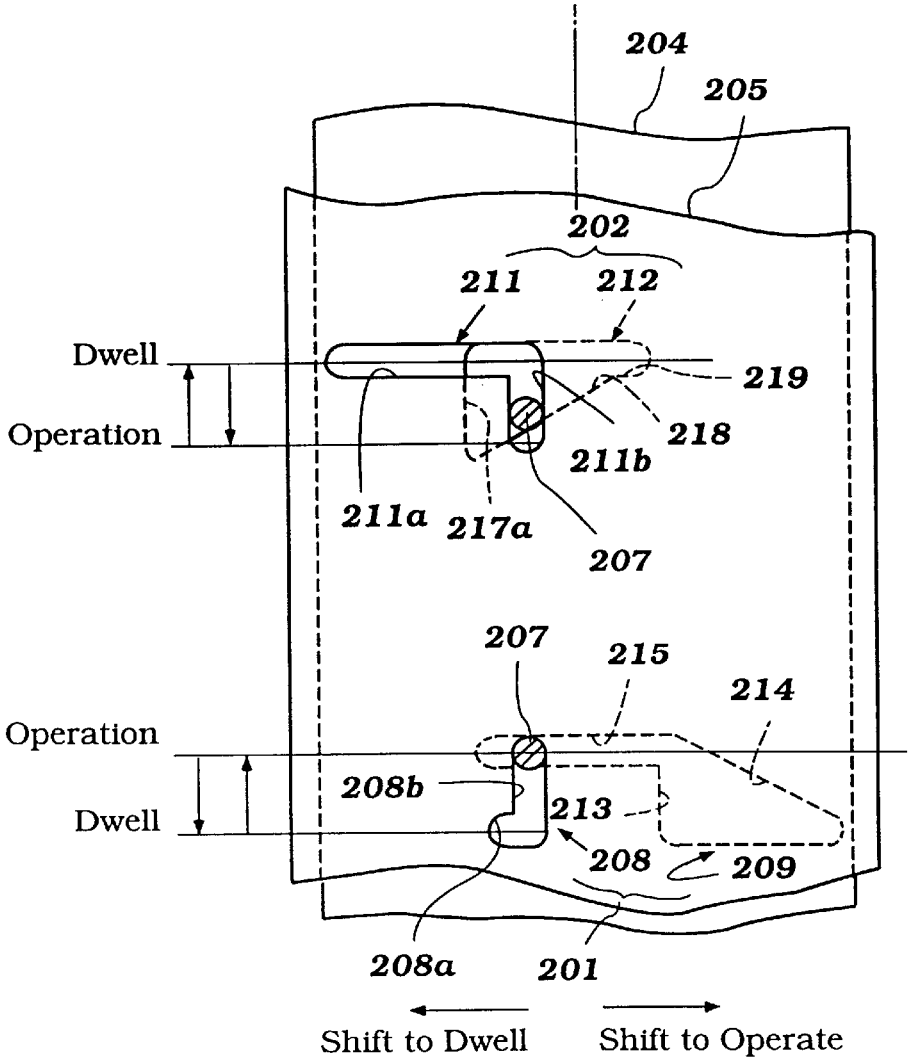
FIG. 14 is an enlarged perspective view, partially developed so as to show the valve controlling mechanism for this embodiment.
Figure 16:
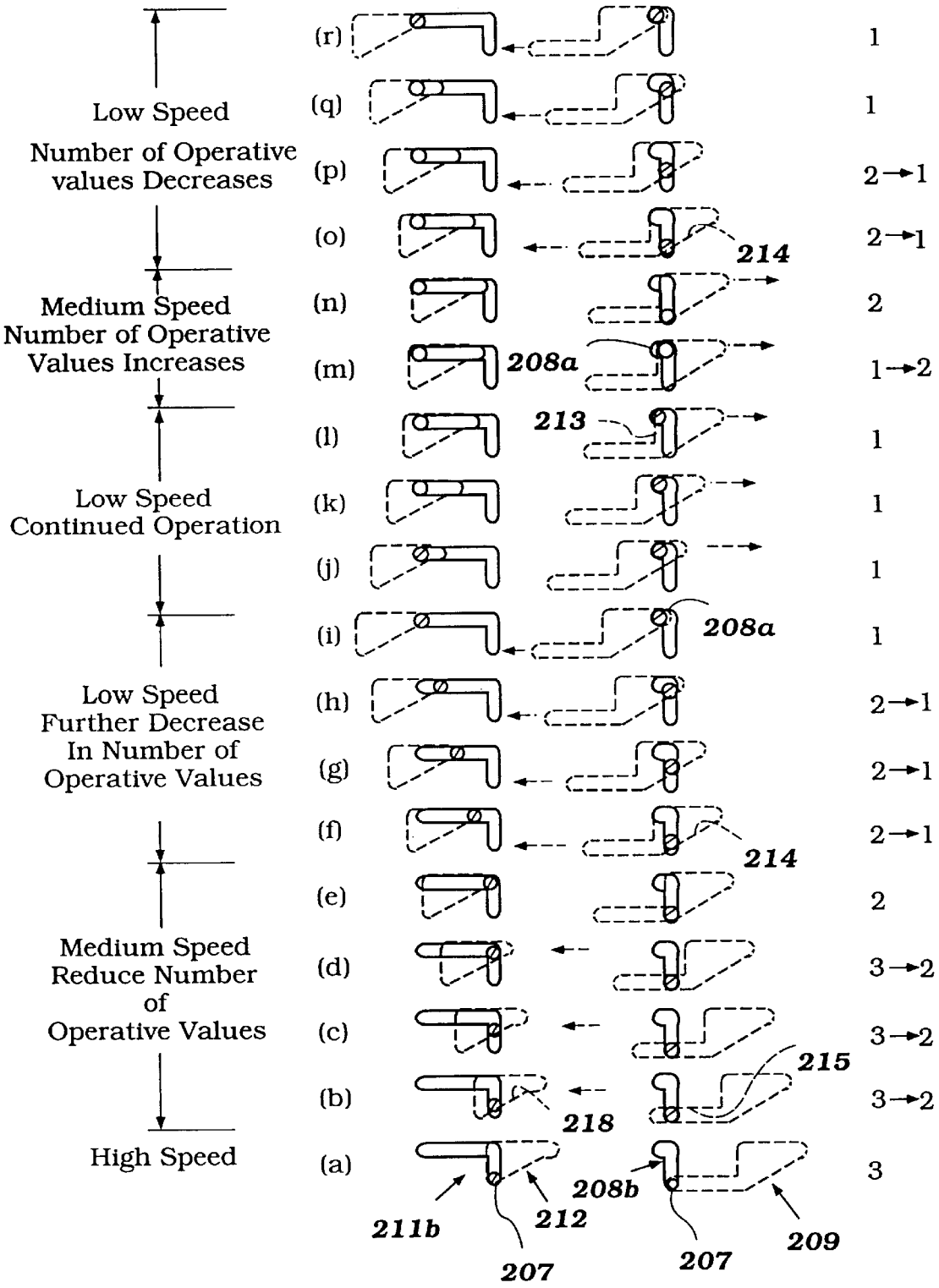
FIG. 16 is a multi-part view showing the transition from operating from three valves per cylinder to one valve per cylinder on the intake side.

Beginning at point "a" in FIG. 16, this corresponds to the position shown in FIG. 14 and is the high-speed/high-load condition. In this condition, the rocker arm's 88 associated with each of the side intake valves 44S are moved by the springs 90 to their operative position so as to be engaged with and actuated by the high-speed cam lobes 87. At this time, the pins 207 will be at the ends or close to the ends of the slots 208*b* and 211*b*. The pin 207 associated with the right-hand intake valve will be captured in the elongated groove 215 of the inner rocker shaft 204 while the pin 207 of the left-hand valve will be engaged with the inclined surface 218 of the triangular groove 217 of the inner rocker arm shaft 204.

As the speed of the engine falls, the inner rocker arm shaft 204 will be rotated in the counter-clockwise direction as viewed in FIG. 14 or to the left as seen in FIG. 16. This will cause the inclined surface 218 of the actuator mechanism 202 to cause the pin 207 of the right-hand rocker arm to slide along the slot 211*b* so as to begin to move the rocker arm 89 in a direction away from engagement with the high-speed cam lobe 87 and into registry with the no-lift cam lobe 83. The spring 90 is compressed at this time.

This movement continues through the positions b,c,d, until the point e when the right-hand rocker arm 88 and its follower surface 89 is free of the high-speed cam lobe 87 and in engagement with the no-lift cam lobe 83. At this time, the engine will have transitioned from operation with three intake valves per cylinder to two intake valves per cylinder. During the aforenoted movement, the groove 209 of the inner rocker arm shaft 204 associated with the left-hand intake valve will have traversed the slot 215 and will be in registry with the inclined surface 214 of the triangular slot 213.

If the speed of the engine continues to fall then the inner rocker arm shaft 204 is continued to rotate in the counter-clockwise direction or to the left as shown in FIG. 16 through the range indicated f through i. When this occurs, the triangular-shaped portion 217 and specifically the inclined surface 218 of the inner rocker arm shaft 204 causes the pin 207 to enter the straight slot 219 and the pin 207 associated with the right-hand rocker arm 88 will move along the slot 211*a* to cause a dwell action wherein the valve is still maintained in its inoperative or low-left condition.

Figure 15:
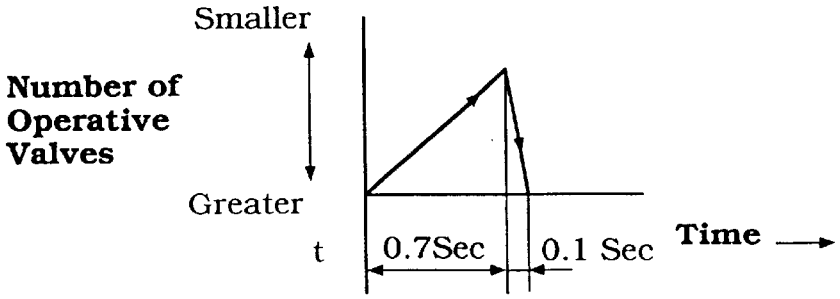
FIG. 15 is a time diagram showing the time change between going from one intake valve operation to three intake valve operations and returning.

As the inner rocker arm shaft 204 continues to rotate in the counter-clockwise or left-hand direction then the inclined surface 214 of the actuating groove 209 of the inner rocker shaft 204 associated with the left-hand intake valve contacts the pin 207 and moves it along the slot portion 208*b* of the outer rocker arm shaft 205 until it reaches the dwell position defined by the circumferential slot 208*a* of the groove 208 of the outer rocker arm shaft 205. Thus, in this condition, both of the side intake valves 44S are either totally disabled or operated in their low-lift condition, depending upon whether a lift load is provided on the low-speed cam 85. This total operation takes place over a time of about 0.7 seconds as shown in FIG. 15, assuming there is continued rotation of the inner rocker arm shaft 204 through its full range of movement.

It should be noted that at the point i of FIG. 16, the pin 207 associated with the left-hand rocker arm has been brought to the end of the circumferential slot 208*a*. Thus, there has been some lost motion occur during this operation.

If the low-speed running condition persists for a time period then the control strategy operates so as to begin to rotate the inner rocker arm shaft 204 in a clockwise direction to the right as shown in FIG. 16. This takes place through the positions j through k. During this time period, there is no actual movement of the rocker arms 88. However, the rotation of the inner rocker arm shaft 204 causes both the triangular slot portions 213 and 217 of the rocker arm actuating mechanisms 201 and 202 to traverse a portion of their stroke so as to take up the lost motion. During this time, the slot 217 of the mechanism 202 will have reached the end of its stroke as seen in view 1 of this figure. Also, the triangular portion 213 of the actuating slot 209 associated with the right-hand intake valve will also have moved substantially to the end of its stroke so that the pin 207 will be engaged by the axially extending portion of this triangular recess 213.

Figure 9:
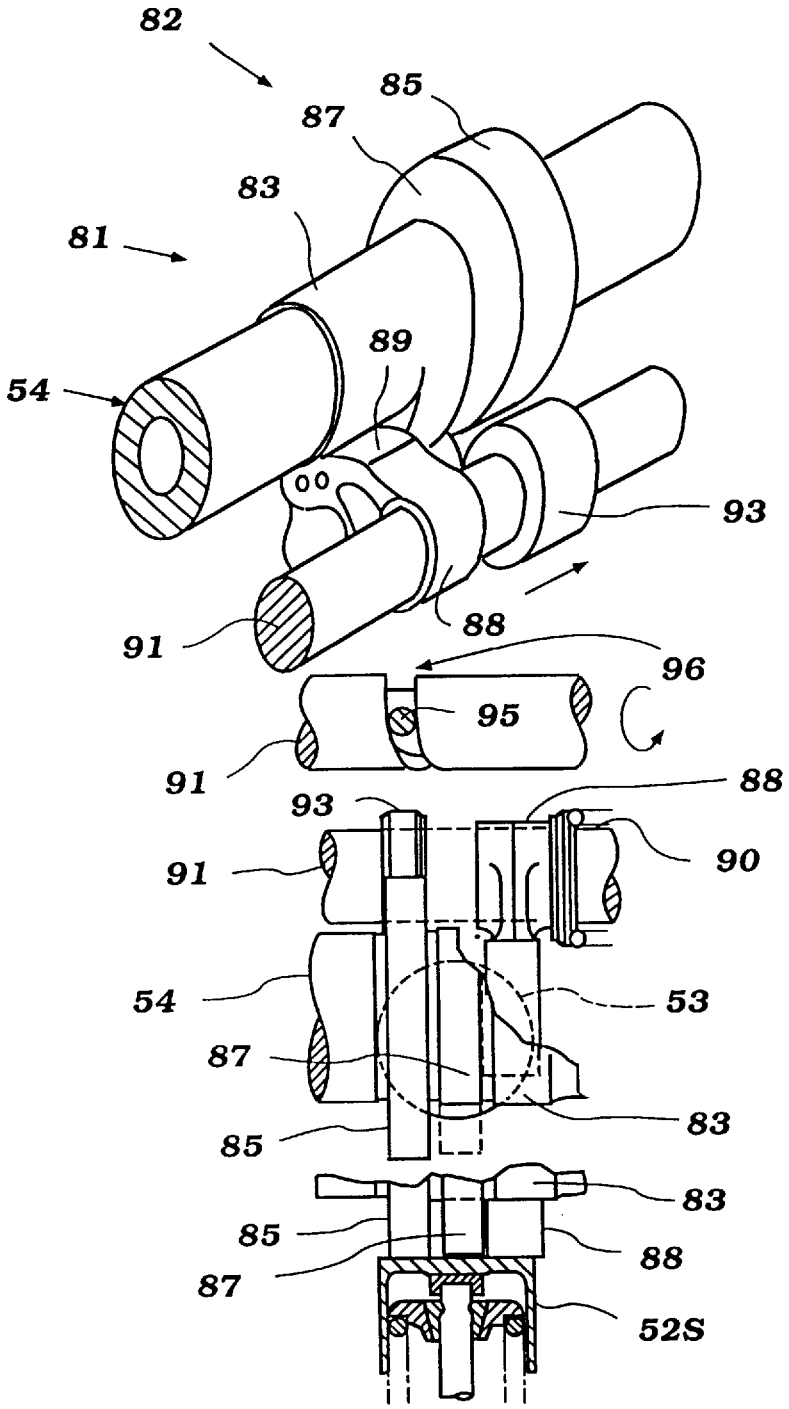

Thus, if the engine speed then begins to increase as shown at the points m and n in FIG. 16, continued rotation of the inner rocker arm shaft 204 will occur and the pin 207 associated with the left-hand intake valve will be brought to the end of the slot 208*a* in registry with the slot 208*b* as shown at view m in this figure. When this occurs, the coil compression spring 90 will act upon the rocker arm 88 associated with this valve, which is no longer restrained within the slotted portion 208 and will urge the rocker arm back toward its engaged position with the high-speed cam lobe 87 as seen in FIGS. 9 and 10 and this intake valve will then begin to operate again. This occurs at the point n in FIG. 16.

Thus, since the lost motion of the mechanism is taken up during the continued low-speed operation, the return to operation of a greater number of valves occurs at a greater rate than the decrease in number of valves. This is important in ensuring good engine performance. The more rapid increase in the number of valves operating during acceleration provides better acceleration whereas the slower decrease in the number of valves operating during deceleration also improves deceleration characteristics.

If at the position n in FIG. 16, the engine again reduces in speed, then the inner rocker arm shaft 204 is again rotated in a counter-clockwise direction or to the left as shown in this figure. During this time, the inclined surface 214 of the inner rocker arm shaft 204 again engages the pin 207 and moves it transversely across the slot 208*b* and into the dwell portion aligned with the slot 208*a* so as to decrease the number of valves operating back to one, the center intake valve 44C. This operation continues to the point indicated at view r of FIG. 16.

The transition from low-speed operation wherein only one intake valve is operative to high-speed operation wherein all of the intake valves are operative will now be described by reference to FIG. 17. FIG. 17 shows a condition where there is continued low-speed running and at the positions a, b, and c, the inner rocker arm shaft 204 is rotated in a clockwise direction or to the right so as to take up the lost motion in the system the same as occurs at the steps j through l of FIG. 16. At the end of the position c, it will be seen that the right-hand rocker arm and specifically the triangulated slot portion 217 thereof has been moved so that its edge will be adjacent to the pin 207 but still slightly out of contact with it. As far as the left-hand rocker arm is concerned, the triangular portion 213 of the inner rocker arm shaft 204 will have moved so that the base of its triangular slot will be engaged with the pin 207 but will not have moved the pin. Hence, the lost motion has been taken up so that the resumption or increase in number of operating valves can occur almost instantaneously.

Therefore, when the engine speed increases at the point d, the inner rocker arm shaft 204 is rotated in the clockwise direction so that the flat surface of the triangular slot 213 engages the pin 207 and moves it along the length of the slot 208*a* into registry with the axially extending slot portion 208*b*. The coil spring 90 then can urge the rocker arm 88 into position for engagement with the high-speed cam lobe 87 as shown in FIGS. 9 and 10. Thus, the engine immediately transitions to the operation of two intake valves per cylinder with the left-side intake valve and center intake valves 44S and 44C both operating.

Figure 17:
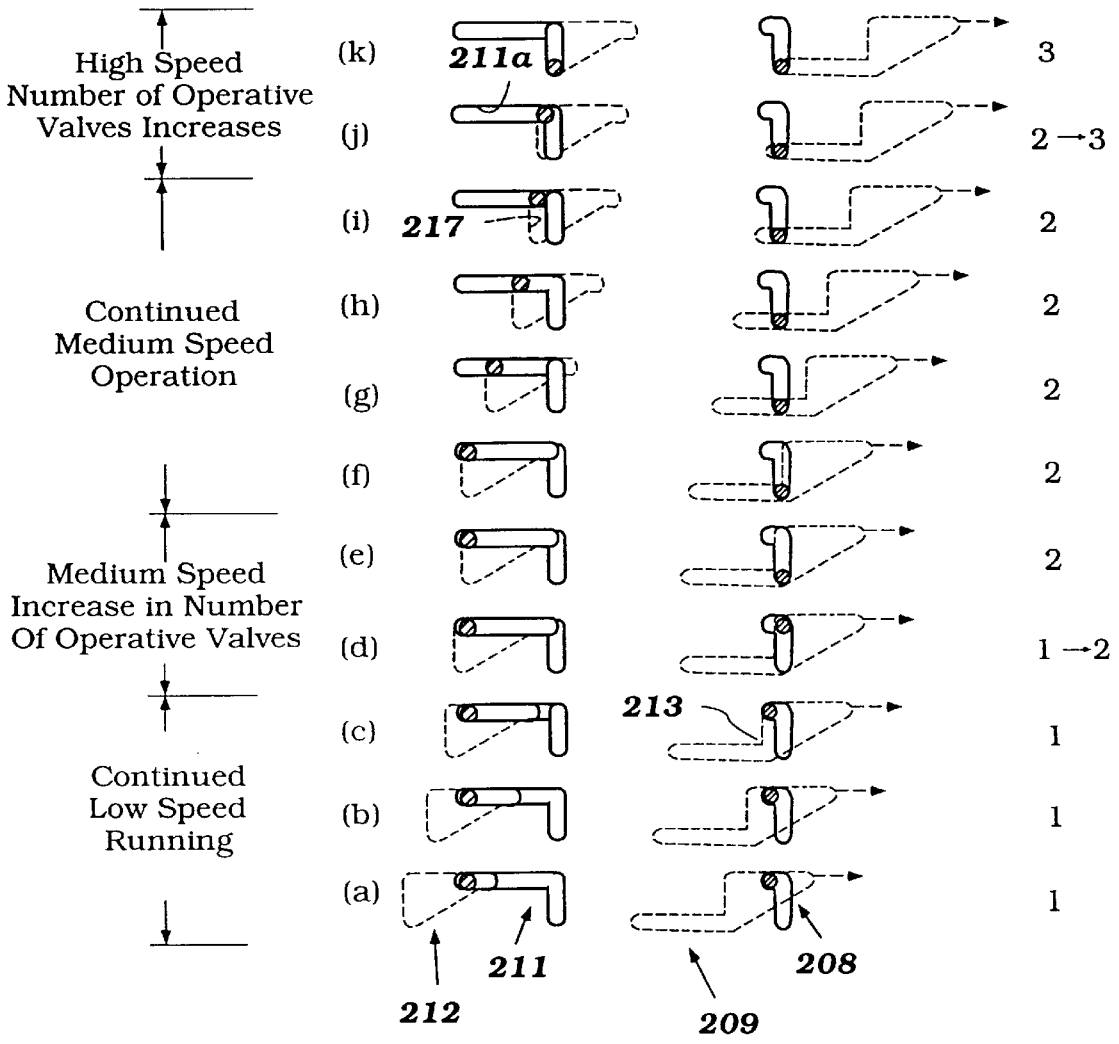
FIG. 17 is a diagrammatic view, in part similar to FIG. 16, and shows the return of operation from one valve per cylinder back to three valves per cylinder on the intake side.

If the engine continues to operate under medium load and speed conditions for some time period, then the inner rocker arm shaft 204 is continued to be rotated in the clockwise direction or to the right as shown in FIG. 17 through the positions shown at f through i. During this time, the inner rocker arm shaft 204 traverses along the pin 207 and no operation of the left-hand intake valve is altered. On the other hand, the triangular slot 217 associated with the right-hand rocker arm pin 207 engages it and moves it along the slot portion 211*a* to a point adjacent but not in registry with the slot portion 211*b*. Hence, the system is triggered so as to be ready to immediately transition to three valve operation if the engine speed increases. On the other hand, if the engine speed decreases and there is a delay in reducing the number of operating valves, this presents no significant problem and in fact it is desirable.

If, however, the engine speed increases, then the inner rocker arm shaft 204 is again rotated in the clockwise direction or to the right as shown in FIG. 17. When this occurs, the triangular slot 217 will move the pin 207 of the right rocker arm shaft stopper member to registry with the groove 211*b* as seen in view i and then the coil compression spring 90 will effect movement of the stopper ring 206 so as to permit the remaining intake valve rocker arm 88 to move into registry with the high-speed cam 87 as shown at k in FIG. 17 so as to now operate with three intake valves per cylinder.

The valve actuating mechanism of this embodiment operating with the controlled exhaust valve will now be described by reference to FIGS. 18 and 19. Like the rocker arm shaft mechanism associated with the intake valves, the rocker arm shaft associated with the exhaust valves is comprised of an inner rocker arm shaft 221, which is rotatable under the operation of the servomotor 99 in the manner previously described. In addition, there is provided a tubular outer rocker arm shaft 222 which is generally fixed against rotation. The inner rocker arm shaft 221 is formed with a groove portion indicated at 223 which is comprised of a triangular-shaped part having an inclined camming surface 224 and an axially extending portion 225. In addition, there is a circumferential dwell slot 226.

The outer rocker arm shaft 222 is also formed with a groove, indicated generally by the reference numeral 227 which includes a circumferentially extending portion 228 and an axially-extending portion 229. Finally, the stopper ring 112 associated with the controlled exhaust valve carries a pin 231 that is engaged with an axially-extending slot formed in the cylinder head 32 and which is received within the inner and outer rocker arm slots 223 and 227, respectively.

Figure 19:
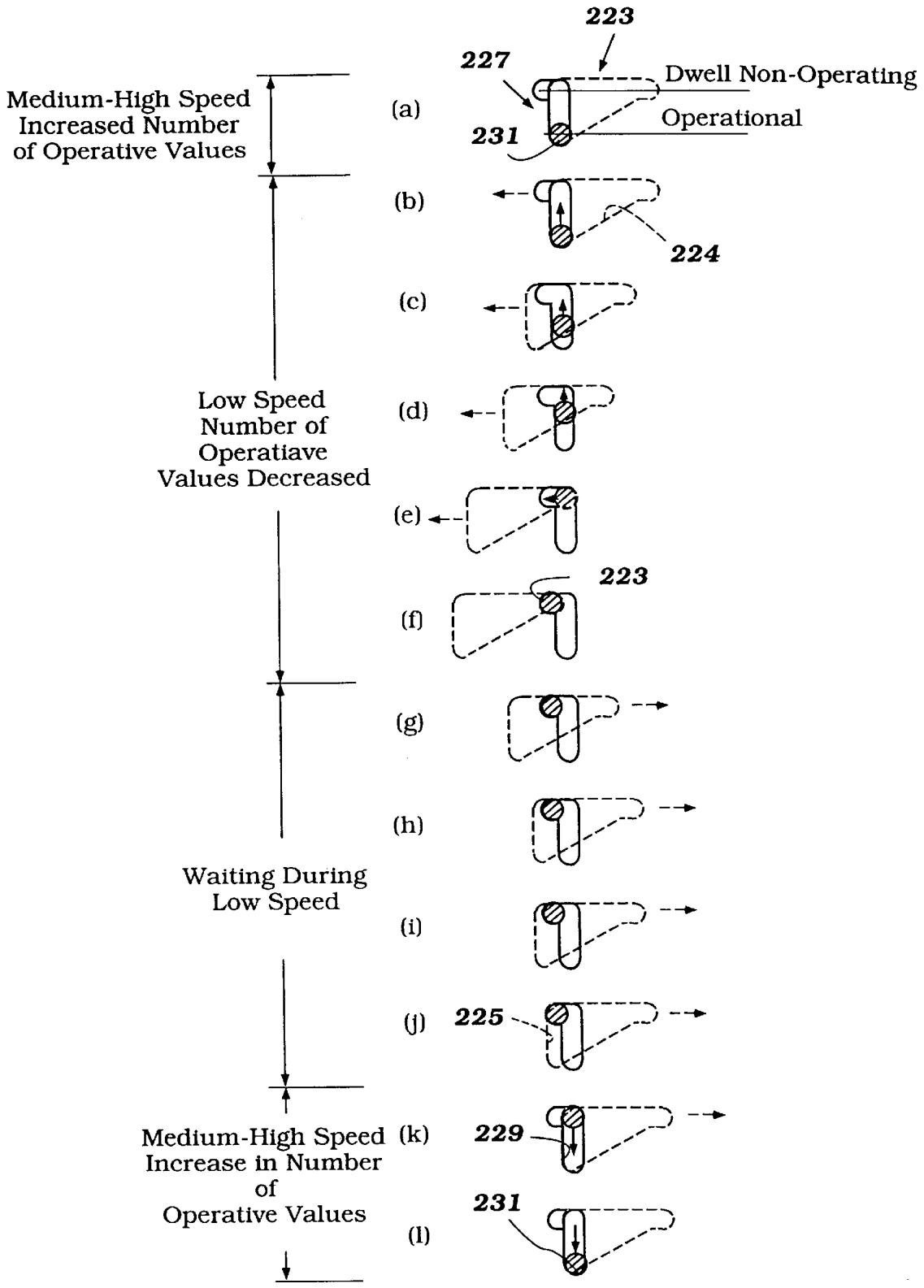
FIG. 19 is a diagrammatic view, in part similar to FIGS. 16 and 17, and shows the arrangement for one of the exhaust valves.

Referring now to FIG. 19, the upper a view shows the medium and high-speed operation when both exhaust valves 59 are being operated. In this condition, the inner rocker arm shaft 221 has been rotated in a clockwise direction to the right as seen in FIG. 19 so that the triangular portion 225 has been brought to move the pin 231 into the axially-extending slot portion 229 of the outer rocker arm shaft 222 so that the -coil compression spring 109 can move the exhaust rocker arm 111 into engagement with the respective high-speed exhaust cam lobe so as to effect operation of the controlled exhaust valve as well as the noncontrolled exhaust valve.

If the engine speed begins to decrease to the point where the control strategy calls for the operation of only a single exhaust valve, then the inner rocker arm shaft 221 is rotated by the servomotor 99 in the counter-clockwise direction or to the left as shown in FIG. 19.

Thus, upon initial rotation in this direction, the inclined surface 224 of the inner rocker arm shaft groove 223 urges the pin 231 along the axial slot portion 229 of the outer rocker arm groove 227. This motion continues through the points b through e until the pin 231 has been brought into registry with the circumferential slot portion 228 of the outer rocker arm groove 227. Continued rotation of the inner rocker arm shaft 221 in the counter-clockwise direction or to the left as seen in FIG. 19 causes the pin 231 to engage the circumferential slot portion 226 of the inner rocker arm 221 and the pin 231 is drawn into the slot 226 so as to lock the rocker arm 111 in a nonoperative position so that it no longer is engaged by the high-speed cam lobe and this valve either will not operate or will operate only with small lift depending upon whether the corresponding low-speed cam lobe has a lift portion or not.

Like the intake valve operation, the transition of exhaust valve operation from a greater to a smaller number of valves occurs over a relatively long time interval. This is because of the lost motion created by the length of the slot 229 of the outer rocker arm shaft 222.

If the engine continues to run at low-speed for a time interval, then in accordance with the strategy, the inner rocker arm shaft 221 is rotated in the clockwise direction or to the right as shown at g through j of FIG. 19 to take up the lost motion. Thus, the inner rocker arm slot 223 is rotated relative to the pin 231 which is captured in the slot 228. Hence, this motion can continue until the flat portion 225 of the inner rocker arm shaft slot 223 engages the pin 231 as shown at view j in FIG. 19.

Thus, if the speed of the engine subsequently increases, further rotation of the inner rocker arm shaft 221 will immediately cause the slot surface 225 to engage and move the pin 231 along the outer rocker arm shaft slot portion 228 into registry with the slot portion 229. The coil compression spring 109 associated with the stopper ring 112 coupled to the pin 231 will then move the stopper ring so that the rocker arm 111 can move into registry with the high-speed lobe of the exhaust cam shaft 71 so that both exhaust valves will now be operated. This motion is shown at k and l in FIG. 19.

Thus, from the described operation it should be readily apparent that the described mechanism provides a very effective way in changing the lift of intake or exhaust valves and also permits the disabling of one or more valves so as to improve engine performance at low-speed and low-loads without sacrificing high-speed performance. Of course, the foregoing description is that of preferred embodiments of the invention, and various changes and modifications may be made without departing from the spirit and scope of the invention, as defined by the appended claims.

What is claimed is:

1. A valve operating mechanism for a reciprocating machine comprised of first and second poppet valves each supported for reciprocation about respective reciprocal axes, a cam shaft journalled for rotation about a cam shaft axis, first and second cam and followers each associated with a reactive one of said poppet valves for controlling the position of said poppet valves, the cams of said first and said second cam and followers being fixed for rotation with said cam shaft, each of said first and second cam and followers being movable between a first condition and a second condition for effecting different lift characteristics of the respective actuated poppet valve during a single rotation of said cam shaft, and a single mechanical actuator for operating said first and said second cam followers between said first and said second conditions in a sequence so that one of said cam and followers is moved between its first and second condition before the condition of the other of said cam and followers is changed.

2. A valve operating mechanism as set forth in claim 1, wherein the first and second cam and followers each include one rocker arm moveable by the single mechanical actuator between first and second positions for effecting respectively the first and second conditions, said rocker arms being movable in the same direction between their first and second positions.

3. A valve operating mechanism as set forth in claim 2, wherein the cams of the cam shaft that form the cam portions of the respective first and second cam and followers each comprise a respective first cam that directly operates the respective valve at the first lift condition, a second cam lobe that operates the respective valve through the respective rocker at the second lift condition, said cam shaft being further provided with a pair of third cam lobes having no lift and wherein the rocker arm of the respective valve is moved by the single mechanical actuator in registry with the respective third cam lobe when the first cam lobes are operating the poppet valves.

4. A valve operating mechanism as set forth in claim 3, wherein the heel diameter of the second cam lobes is the same as the diameter of the third cam lobes so that the rocker arms may slide from the registry with the third cam lobes to the second cam lobes when on the heel of the second cam lobes.

5. A valve operating mechanism as set forth in claim 4 wherein a spring biases the rocker arms toward the second cam lobes.

6. A valve operating mechanism as set forth in claim 5, wherein the spring encircles the rocker arm shaft between the rocker arms for engaging the rocker arms and moving them in opposite directions relative to each other.

* * * * *

UNITED STATES PATENT AND TRADEMARK OFFICE

CERTIFICATE OF CORRECTION

PATENT NO. : 5,809,953
DATED : September 22, 1998
INVENTOR(S) : T. Saito et al.

It is certified that error appears in the above-identified patent and that said Letters Patent is hereby corrected as shown below:

Column 16,
Line 21, "reactive" should be changed to "respective"

Signed and Sealed this

Eleventh Day of December, 2001

*Attest:*

Nicholas P. Godici

NICHOLAS P. GODICI
*Acting Director of the United States Patent and Trademark Office*

*Attesting Officer*